US010689932B2

(12) United States Patent
Robertson et al.

(10) Patent No.: US 10,689,932 B2
(45) Date of Patent: Jun. 23, 2020

(54) CASING REMOVAL TOOL AND METHODS OF USE FOR WELL ABANDONMENT

(71) Applicant: Robertson Intellectual Properties, LLC, Arlington, TX (US)

(72) Inventors: Michael C. Robertson, Arlington, TX (US); Douglas J. Streibich, Fort Worth, TX (US); Antony F. Grattan, Mansfield, TX (US); William F. Boelte, New Iberia, LA (US)

(73) Assignee: ROBERTSON INTELLECTUAL PROPERTIES, LLC, Mansfield, TX (US)

( * ) Notice: Subject to any disclaimer, the term of this patent is extended or adjusted under 35 U.S.C. 154(b) by 654 days.

(21) Appl. No.: 15/001,055

(22) Filed: Jan. 19, 2016

(65) Prior Publication Data

US 2016/0130903 A1 May 12, 2016

Related U.S. Application Data

(63) Continuation-in-part of application No. 14/930,369, filed on Nov. 2, 2015, now Pat. No. 10,246,961, and a continuation-in-part of application No. 14/143,534, filed on Dec. 30, 2013, now Pat. No. 9,416,609, and a continuation-in-part of application No. 13/815,691, filed on Mar. 14, 2013, now Pat. No. 9,388,684, and a continuation-in-part of application No. 13/815,694, filed on Mar. 14, 2013, now Pat. No. 9,580,984, and a continuation-in-part of application No. 13/507,732, filed on Jul. 24, 2012, now Pat. No. 9,863,235.

(60) Provisional application No. 62/105,130, filed on Jan. 19, 2015.

(51) Int. Cl.

| | |
|---|---|
| ***E21B 29/02*** | (2006.01) |
| ***E21B 23/06*** | (2006.01) |
| ***E21B 31/16*** | (2006.01) |
| ***E21B 23/00*** | (2006.01) |
| ***E21B 41/00*** | (2006.01) |

(52) U.S. Cl.

CPC ..... *E21B 29/02* (2013.01); *E21B 23/006* (2013.01); *E21B 31/16* (2013.01); *E21B 41/0078* (2013.01)

(58) Field of Classification Search

None

See application file for complete search history.

(56) References Cited

U.S. PATENT DOCUMENTS

| | | | |
|---|---|---|---|
| 3,269,467 | A | 8/1966 | Bell |
| 6,298,915 | B1 | 10/2001 | George |
| 6,474,415 | B1 | 11/2002 | Ohmer |

(Continued)

*Primary Examiner* — James G Sayre
*Assistant Examiner* — Douglas S Wood
(74) *Attorney, Agent, or Firm* — Matthews, Lawson, McCutcheon & Joseph, PLLC

(57) ABSTRACT

Systems and methods for removing casing from a wellbore including a casing removal tool that includes a tubular body configured to contain a thermite fuel mixture configured to initiate into a molten thermite fuel. The casing removal tool also includes a nozzle array having a plurality of nozzles positioned on an external surface of the tubular body. The nozzle array is configured to impinge the molten thermite fuel from within the tubular onto the wellbore casing. The casing removal tool also includes an orientation lug configured to anchor into a downhole orientation tool.

28 Claims, 10 Drawing Sheets

(56) References Cited

U.S. PATENT DOCUMENTS

| | | | | |
|---|---|---|---|---|
| 6,695,056 | B2 * | 2/2004 | Haugen | E21B 7/061 166/117.6 |
| 9,677,365 | B2 * | 6/2017 | Tallini | E21B 29/02 |
| 2004/0089450 | A1 | 5/2004 | Slade et al. | |
| 2010/0218952 | A1 | 9/2010 | Robertson | |
| 2012/0199340 | A1 | 8/2012 | Robertson | |
| 2013/0292108 | A1 | 11/2013 | Hutchinson | |
| 2014/0262270 | A1 | 9/2014 | Robertson et al. | |

* cited by examiner

CASING REMOVAL TOOL AND METHODS OF USE FOR WELL ABANDONMENT

CROSS REFERENCE TO RELATED APPLICATIONS

This application is a non-provisional application that claims the benefit of U.S. Provisional Application Ser. No. 62/105,130, entitled "Casing Removal For Well Abandonment," filed Jan. 19, 2015, and is a continuation-in-part that claims the benefit of U.S. patent application Ser. No. 14/930,369, entitled "Setting Tool For Downhole Applications," filed Nov. 2, 2015, U.S. patent application Ser. No. 13/815,691, entitled "Modulated Formation Perforating Apparatus And Method For Fluidic Jetting, Drilling Services Or Other Formation Penetration Requirements," filed Mar. 14, 2013, U.S. patent application Ser. No. 13/815,694, entitled "Apparatus And Methods For Overcoming An Obstruction In A Wellbore," filed Mar. 14, 2013, U.S. patent application Ser. No. 14/143,534, entitled "Tool Positioning and Latching System," filed Dec. 30, 2013, and U.S. patent application Ser. No. 13/507,732, entitled "Permanent Or Removable Positioning Apparatus And Method For Downhole Tool Operations," filed Jul. 24, 2012, all of which are incorporated herein in their entireties.

FIELD OF THE INVENTION

The present application relates, generally, to the field of downhole tools. More particularly, the application relates to methods and tools for removing casing from a wellbore, which can be usable for the abandonment, or partial abandonment, of the well.

BACKGROUND

When an oil and/or gas well, or a portion of the well, ceases to become economically viable, that well or portion of the well may be abandoned. Abandoning a well involves sealing the intervals of the well to prevent the migration of oil, gas, brine and other substances into freshwater and preventing the migration of water or other contaminants into the oil and gas reservoirs.

A wellbore is very often drilled to depths many thousands of feet from the surface. The resulting disruption of geologic formations can cause contamination of otherwise useful fluid reserves when a fluid from one formation flows through the wellbore to a different formation. Well owners and operators have long known of these potential risks, but have increasingly become aware of the changes that can occur within a wellbore over very long periods of time. Past preferred methods of properly abandoning and preventing leakage between fluid reserves included placing cement plugs within the wellbore, across and on top of hydrocarbon bearing or aquifer zones. That cement placement forms a long-term seal and isolation of the formations of interest. The interval to be cemented may be up to several hundred feet in length.

The wellbore, however, may include fissures running on the outside of the outermost casing. Leakage between formations may thus occur on the outside of the casing even if the inside of the casing is sealed by a cement plug. The industry has increasingly become aware of the need to remove the casing entirely from within wellbore. When the casing is completely removed, the cement plug directly contacts the formation. Using existing equipment, operators generally remove the outermost casing using mechanical milling techniques; however, there are many drawbacks to the milling process. The operation is slow and may take a month or more to complete. The contaminated metal cuttings of the casing must be returned to the surface for processing and disposal. The milling drill must be large and powered by heavy rigs at the surface of the wellbore. Furthermore, if there is any interior casing or production tubing strings left in the wellbore, those must be removed before any drilling of the external casing. Therefore, a need exists for a long-term seal of a wellbore while minimizing time and financial resources used in pulling casing and/or production tubing strings from a wellbore and milling the outermost casing.

Alternatively to milling the casing, some abandonment projects consider perforation of the casing to be adequate. Operators typically use explosive perforating techniques to form holes in the casing throughout the zone(s) to be plugged. As known in the art, a perforating gun containing a series of shaped charges is lowered into the wellbore and the charges are ignited through electrical or mechanical means. The perforations provide a flow-path for cement between the interior of the casing and the annulus.

While perforation is typically easier than complete removal of the casing, perforation has several drawbacks. It is often difficult to achieve an adequate flow-path between the interior of the casing and the annulus, in some instances. Inadequate or inconsistent explosive perforation through the casing prevents cement from adequately flowing between the interior of the casing and the annulus. Under those conditions, the cement may not completely seal the annulus. These problems have been addressed, in some instances, by implementing a "cement squeeze," into the targeted area. A cement squeeze is a technique in which the cement is highly pressurized as it is forced into the wellbore. The pressurization is believed to ensure that cement fills any and all cracks in the casing or surrounding formation. A cement squeeze may be especially employed in wellbores which have multiple layers of piping and/or casing. That is, the inner tube string(s) may be perforated with a perforating gun and cement squeezed into the area. The cement is forced through the perforations in the inner tube string and fills the annulus between the inner tube string and the outer casing layer.

In a properly formed cement squeeze, cement hardens on both sides of the casing, ostensibly sealing that zone of the wellbore. Long term studies of wellbores have revealed, however, that after a few years the casing itself starts to deteriorate. In many circumstances, a deteriorating casing leaves fissures through which fluids may leak. Even a properly implemented cement squeeze does not address the problem of casing deterioration. Furthermore, cement squeeze techniques typically still require heavy equipment capable of producing the high pressures.

Therefore, a need exists for a wellbore sealing and isolation technique that does not require milling, explosive perforation, or tubing string extraction.

A need exists for sealing and isolation techniques which do not require a drilling rig, or a high pressurizing rig, to be transported to the wellbore site.

A need exists for sealing and isolation techniques that are not susceptible to fissures caused by deterioration of the casing after a cement plug has been established, which can lead to contamination issues.

Given the drawbacks associated with mechanical milling and with the explosive perforation, there is a need in the art for additional techniques for removing sections of casing or for creating adequate flow paths within the casing to facilitate abandonment operations.

SUMMARY

The present application relates, generally, to methods and tools for removing casing from a wellbore, which can be usable for the abandonment, or partial abandonment, of the well.

The present application includes a casing removal tool for a rigless removal of a portion of a wellbore casing from a wellbore that includes a tubular body configured to contain a thermite fuel mixture configured to initiate into a molten thermite fuel, and a nozzle array including a plurality of densely packed nozzles positioned on an external surface of the tubular body. The nozzle array can be configured to impinge the molten thermite fuel onto a section of the wellbore casing so that the molten thermite fuel, from each of the nozzles in the plurality of nozzles, can at least partially overlap the molten thermite fuel from each adjacent nozzle in the plurality of nozzles. The casing removal tool can further include an orientation lug configured to anchor into a downhole orientation tool.

Other embodiments of the casing removal tool can have an orientation lug that can be configured to be set by an operator at a specific orientation before entering the wellbore. The casing removal tool, in some embodiments, may include a second nozzle array that can be configured to impinge the molten thermite fuel onto a second section of the wellbore casing. The casing removal tool, in some embodiments, may have area of the nozzle array that takes up one quarter of a total area of the external surface. That area may include up to a 90° or more rectangular area, and the plurality of nozzles can be uniformly spaced within the rectangular area.

The casing removal tool, in some embodiments, can include a spacer that can be configured to offset the nozzle array by a linear offset distance from the downhole orientation tool. In an embodiment, a centralizer can be configured to orient the casing removal tool relative to a radial center of the wellbore, and to maintain the casing removal tool in the center of the wellbore during operations.

The disclosed embodiments also include a method of removing casing from a wellbore with a casing removal tool. The steps of the method can include lowering the casing removal tool into the wellbore and orienting the casing removal tool within the wellbore at a first linear orientation and a first azimuthal orientation. The casing removal tool includes a tubular body configured to contain a thermite fuel mixture.

The steps of the method can further include initiating a burn of the thermite fuel mixture to produce a molten thermite fuel, projecting the molten thermite fuel through a nozzle array that comprises a plurality of nozzles positioned adjacent to one another, and impinging the molten thermite fuel onto a section of the casing to melt, vaporize, and/or disintegrate the casing. The molten thermite fuel, from each of the nozzles in the plurality of nozzles, can at least partially overlap the molten thermite fuel from each adjacent nozzle in the plurality of nozzles to uniformly melt, vaporize or disintegrate a desired section (e.g., continuous section) of the casing. The steps of the method can further include retrieving the casing removal tool from the wellbore.

The method, in certain embodiments, can further include lowering an additional casing removal tool into the wellbore and orienting, while lowered into the wellbore, the additional casing removal tool within the wellbore. The additional casing removal tool can be oriented at a combination of linear orientation and azimuthal orientation, which is different from the linear orientation and azimuthal orientation of any previously lowered casing removal tool.

The steps of the method can further include initiating a burn of the thermite fuel mixture within the additional casing removal tool to produce a molten thermite fuel and impinging the molten thermite fuel onto an additional section of the casing. Each additional section of the casing is at least partially different from each previous section of the casing to which the molten thermite fuel is applied. The method can include retrieving the additional casing removal tool from the wellbore before lowering a next additional casing removal tool.

In certain embodiments, the method includes lowering and setting a downhole orientation tool prior to lowering the casing removal tool. Each of the casing removal tools is configured to linearly and azimuthally orient based on the downhole orientation tool.

In certain embodiments, the method includes lowering a spacer with each of the casing removal tools to linearly offset each of the casing removal tools from the downhole orientation tool. The spacer may include a length to linearly position the casing removal tool relative to a zone of the casing, and the casing removal tool may remove at least a portion of the casing in the zone prior to adjusting the length of the spacer for the additional casing removal tool or the next additional casing removal tool.

Setting the downhole orientation tool may include perforating holes into the casing with a perforating torch and securing anchor dogs of the downhole orientation tool into the perforated holes, setting a sleeve hanger or a post-positioner with a setting tool, or combinations thereof.

In certain embodiments, orienting the casing removal tool further includes offsetting the casing removal tool from a radial center of the wellbore towards the casing. The casing removal tool may be offset toward the section of the casing impinged by the molten thermite fuel.

In certain embodiments, lowering the casing removal tool into the wellbore includes using a wireline, a slickline, other rigless tool lowering strings, or combinations thereof. Lowering and orienting the casing removal tool may include lowering and orienting the casing removal tool by attaching the casing removal tool to an end of a production tubing drill string.

The disclosed embodiments also describe and support a system for removing wellbore casing from a wellbore that can include a downhole orientation tool configured to be secured within the wellbore, wherein the downhole orientation tool can have a linear and azimuthal orientation keyway, and a plurality of casing removal tools. Each casing removal tool can include an orientation lug that can be configured to orient within the keyway of the downhole orientation tool. An operator can change a position of the orientation lugs before lowering the casing removal tools into the wellbore. The system can further include a nozzle array having a plurality of densely packed nozzles configured to impinge molten thermite fuel onto a continuous section of the wellbore casing after the casing removal tool is lowered into the wellbore, and a spacer configured to offset the nozzle array a linear distance from the downhole orientation tool.

In certain embodiments, the system can include a second spacer configured to offset the nozzle array a second linear distance from the downhole orientation tool. The downhole orientation tool may have a sleeve hanger, a post-positioner, or combinations thereof. In an embodiment, each casing removal tool, in the plurality of casing removal tools, can include a nozzle array that is approximately 6 to 7 meters or more in length and about 90 degrees around an external surface of the casing removal tool.

In certain embodiments, the system can include a centralizer that is configured to orient the casing removal tool relative to a radial center of the wellbore, and maintain the casing removal tool centrally within the wellbore.

In certain embodiments, the system above includes small splinters of the wellbore casing that can be retrieved from the wellbore, removed from the wellbore, or allowed to fall down the wellbore. The small splinters (e.g., small sections) of the wellbore casing are located between the continuous sections of the wellbore casing, onto which the molten thermite fuel is, or has been, projected.

The disclosed embodiments can further include a method of removing casing from a wellbore that includes lowering a casing removal tool into the wellbore through a first wellbore tubing having a first diameter, wherein the wellbore includes the first wellbore tubing and a second wellbore casing. The steps of the method can continue by including the lowering of the casing removal tool through the second wellbore casing, having a second diameter. In this embodiment, the second diameter is larger than the first diameter, and the second wellbore tubing is downhole from the first wellbore tubing. The steps of the method can further include orienting the casing removal tool within the second wellbore casing, initiating the casing removal tool to remove casing from the second wellbore casing, and retrieving the casing removal tool from the wellbore.

In certain embodiments, orienting the casing removal tool can include offsetting the casing removal tool from a radial center of the wellbore towards the casing. Also, orienting the casing removal tool may include anchoring the casing removal tool to an orientation tool that remains secured within the wellbore after the casing removal tool has been retrieved from the wellbore.

DETAILED DESCRIPTION

Before describing selected embodiments of the present disclosure in detail, it is to be understood that the present invention is not limited to the particular embodiments described herein. The disclosure and description herein is illustrative and explanatory of one or more presently embodiments and variations thereof, and it will be appreciated by those skilled in the art that various changes in the design, organization, means of operation, structures and location, methodology, and use of mechanical equivalents may be made without departing from the spirit of the invention.

It should be understood, as well, that the drawings are intended to illustrate and plainly disclose embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

The methods and tools described herein use an exothermic, thermite reaction to controllably remove large, complete sections of casing or to penetrate the casing with holes of adequate size to provide a reliable flow-path for plugging/abandonment operations. Rather than making small holes for extraction of production fluid, or for aligning tools within the wellbore, the methods and tools described herein are used to remove continuous and uniform sections of casing from the wellbore. A casing removal tool is deployed into the cased wellbore. Several types of casing removal tools may be employed to remove casing from the wellbore. Each of which may have a small cross-sectional diameter such that the casing removal tool may be lowered through tubing of a narrow width and remove casing from tubing at a wider width. The casing removal tool may include, for example, thermite that may be initiated and projected upon the casing. The molten thermite impinges onto the steel casing and melts, vaporizes, and/or disintegrates the casing. The destruction of the casing is caused both by the heat of the molten thermite and by the pressure (e.g., jet) of the thermite exiting the casing removal tool. The molten thermite and casing typically fall downward within the wellbore immediately after the reaction has completed.

Figure 1:
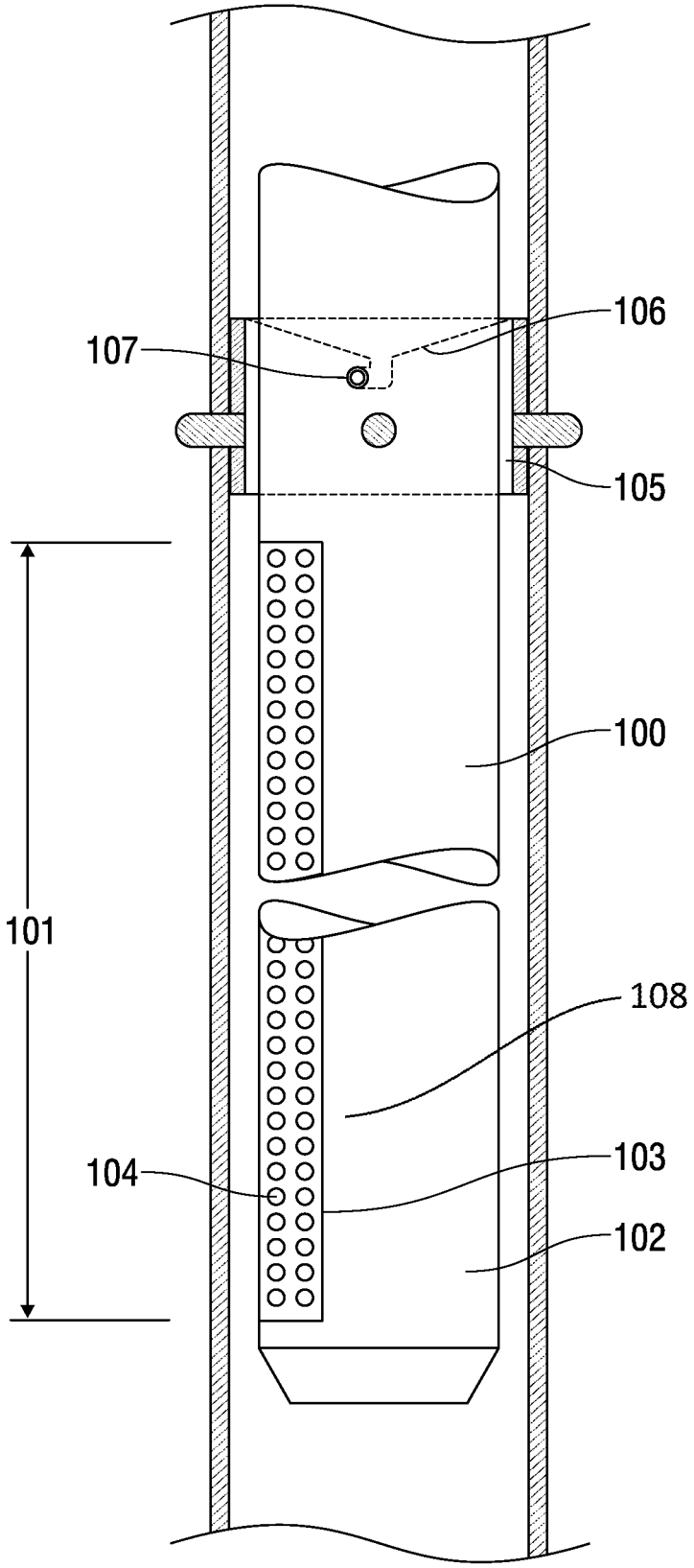
FIG. 1 illustrates an embodiment of a casing removal tool, as described herein.

FIG. 1 illustrates an embodiment of a casing removal tool 100 deployed within an interval 101 of a wellbore. The interval 101 of the wellbore may be located downhole from a narrow production tubing. The casing removal tool 100 is shown as relatively close in width to the casing, but in certain embodiments the casing removal tool 100 may be narrower than the interval 101 of the casing being removed. The casing removal tool 100 is small enough to fit through the narrow production tubing because the techniques disclosed herein are compact and do not require the use of a rig to power the removal of the casing. In fact, in certain embodiments, the casing removal tool is used with a wireline, a slickline, other rigless tool lowering strings, or combinations thereof to deploy the casing removal tool, fire, and retrieve the casing removal tool before a typical rig could even be transported to the wellbore.

The casing removal tool 100 includes a tubular body 102 and a focused nozzle array 103. As explained in more detail below, the tubular body 102 contains solid thermite fuel. The solid thermite fuel may be located within the tubular body 102 adjacent the nozzle array 103, or may occupy internal space within the tubular body 102 for several meters above or below the nozzle array 103. The nozzle array 103 is an area of an external surface 108 of the casing removal tool 100 that includes a plurality of nozzles 104. The area of the nozzle array 103 may vary in size (e.g., length, width, and/or shape). For example, the nozzle array may be about 6.1 meters (twenty (20) feet) in length but the tubular body 102 that houses the fuel may be about 3.0, 6.1, 9.14, 12.19 meters or more (about 10, 20, 30, 40 or more feet) in length. When the solid thermite fuel is initiated, molten thermite is expelled through the nozzles 104 of the nozzle array 103.

Figure 2:
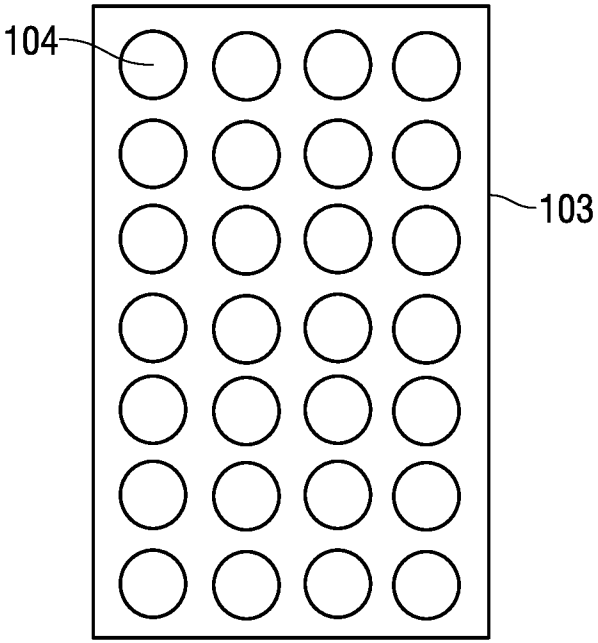
FIG. 2 illustrates a nozzle array of a casing removal tool.

The focused nozzle array 103 is illustrated in more detail in FIG. 2. The plurality of nozzles 104 provide a path for molten thermite contained on the inside of tubular body 102. The nozzles can be less than an inch in diameter and can be less than half-inch in diameter. According to some embodiments, the nozzles can be about 3/16" inches in diameter. However, any diameter of nozzle is within the scope of the disclosure.

The focused nozzle array 103 can be densely packed with nozzles 104. Densely packed nozzles 104 means that the nozzle array 103 has nozzles 104 in which the projection of molten thermite from each nozzle 104 at least partially overlaps the projection of molten thermite from each adjacent nozzle 104. The result from such a nozzle array 103 is a uniform annihilation of a continuous section of the casing in front of the nozzle array 103. For example, a densely packed nozzle array 103 may have an area that is more than fifty percent (50%) occupied with nozzles 104. That is, the area within the nozzle array 103 that is occupied by a nozzle 104 (e.g., a hole in the tubular body 102) is greater than the area within the nozzle array 103 that is between the nozzles 104. According to some embodiments, when the nozzles 104 are about 4.5 mm (about 3/16 inches) in diameter, the nozzles 104 are also spaced about 4.5 mm (about 3/16 inches) from each other. Ideally, and without limitation, when the thermite is initiated, the casing removal tool 100 provides a hole in the casing that is roughly the same size and shape of the nozzle array 103, rather than providing discrete holes corresponding to each nozzle 104. For example, if the nozzle array 103 is 25.4 mm (2 inches) wide and 6.1 meters (20 feet) long, the casing removal tool 100 will provide a 25.4 mm (2 inch) by 6.1 meters (20 foot) hole in the casing.

For removing casing over a long interval, a longer tubular body 102 is desirable. Any length of tubular body 102 is within the scope of the disclosure. However, practical considerations, such as issues with uniformly initiating the solid thermite fuel, may limit the length of the tubular body 102 to about 15.24 meters or less (about fifty (50) feet or less), for example. The embodiment illustrated in FIG. 1 has a tubular body 102 that is about 6.1 meters (20 feet) in length.

The nozzle array 103 may cover any radial area the circumference of the tubular body 102. For example, nozzles 104 may be distributed upon a 360° area of tubular body 104. With such a configuration, the casing removal tool 100 removes an entire longitudinal section of the casing with a single deployment and initiation. More generally, however, the nozzle array 103 covers less than the entire circumference of the tubular body 102. For example, the nozzle array 103 may cover a 90° area of the tubular body 102. According to that embodiment, four deployments of the casing removal tool 100 is needed to remove a continuous interval of casing, with each deployment having the nozzle array 103 rotated along a different 90° section of casing to remove the entire 360° of casing. In certain embodiments, the nozzle array 103 may include a 360° ring around the external surface 108 of the casing removal tool 100.

Figure 3:
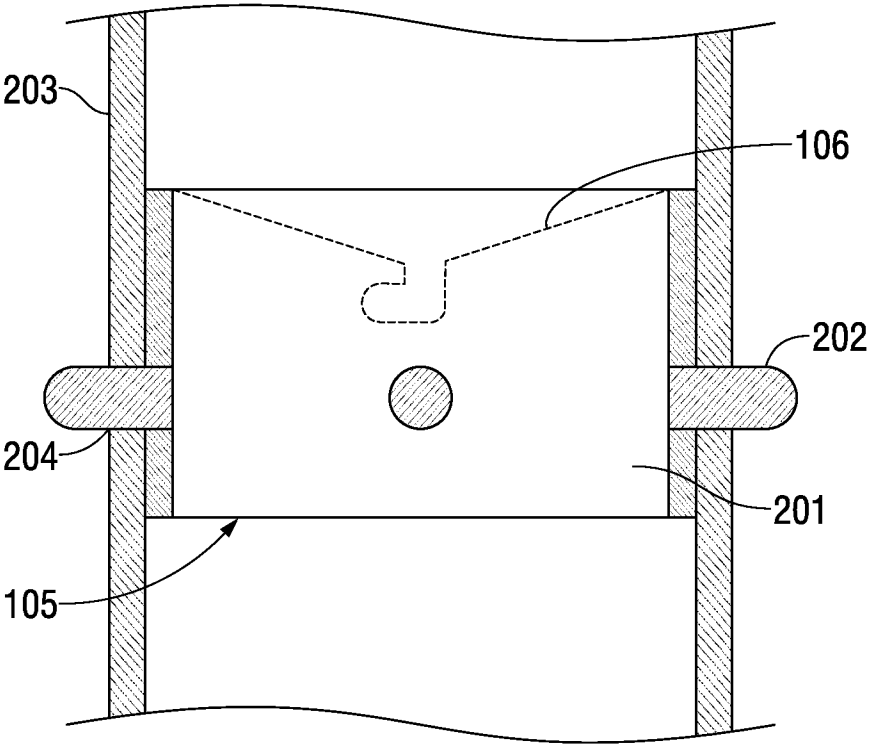
FIG. 3 illustrates a liner orientation tool.

To properly orient the casing removal tool 100, a liner orientation tool 105 may be secured or set within the wellbore. The orientation tool 105 may include a keyway 106 for engaging with a location/orientation lug 107 on the casing removal tool 100. The orientation lug 107 may be adjusted by an operator at the surface of the wellbore to change the azimuthal angle at which the orientation lug 107 interacts with the keyway 106, changing the section at which the casing removal tool 100 impinges. The orientation tool remains fixed in the wellbore and allows multiple deployments and orientations of the casing removal tool 100. An embodiment of a liner orientation tool 105 is illustrated in more detail in FIG. 3. The liner orientation tool 105 comprises a positioning sleeve 201 configured with spring-loaded anchor dogs 202. As the liner orientation tool is deployed, the anchor dogs 202 are held in a retracted position by the inside diameter of casing 203. When the liner orientation tool encounters appropriately spaced anchor holes 204 within the casing, the anchor dogs 202 can extend and engage within the anchor holes 204.

In another embodiment, the orientation tool 105 can be secured in place using a setting tool that forces teeth or dogs against the casing itself. These types of orientation tools 105 may include sleeve hangers (illustrated, for example, by positioning sleeve 201), or may include post-positioners where the casing removal tool 100 slips around the exterior of a post that has been secured within the wellbore. A post-positioner will often be positioned below the area of casing that is being targeted for removal. In an embodiment in which the orientation tool 105 is secured into place by the use of a setting tool, the orientation tool 105 can comprise a first plurality of grooves, which define a first selected profile that is defined by a selected spacing of the first plurality of grooves. Upon lowering a casing removal tool inside the wellbore, the casing removal tool, comprising a first plurality of protruding members, can be positioned and locked into place within the wellbore by the first plurality of protruding members forming a first complementary profile that is configured to lock only within the first selected profile of the orientation tool, thus positioning and locking the casing removal tool into place within the wellbore. This embodiment is further described in relation to FIG. 10.

Once deployed and installed, the liner orientation tool 105 can be used to anchor multiple modular deployments of casing removal tools 100, assuring that the casing removal tools each return to the desired depth within the wellbore each time and align in the correct orientation. For example, the casing removal tools 100, as illustrated in FIG. 1, can be used to remove a 6.1 meter (20-foot) section of casing. In this embodiment, the nozzle array 103 covers a 6.1 meter (20 foot) length of the casing removal tool 100 and covers a 90° radial area. As explained above, changing the azimuthal orientation of the casing removal tool 100 over four separate deployments enables 360° removal of that section of casing. Generally, this method of use would require four different casing removal tools 100, as each tool may be consumed once the thermite is initiated.

Figure 4:
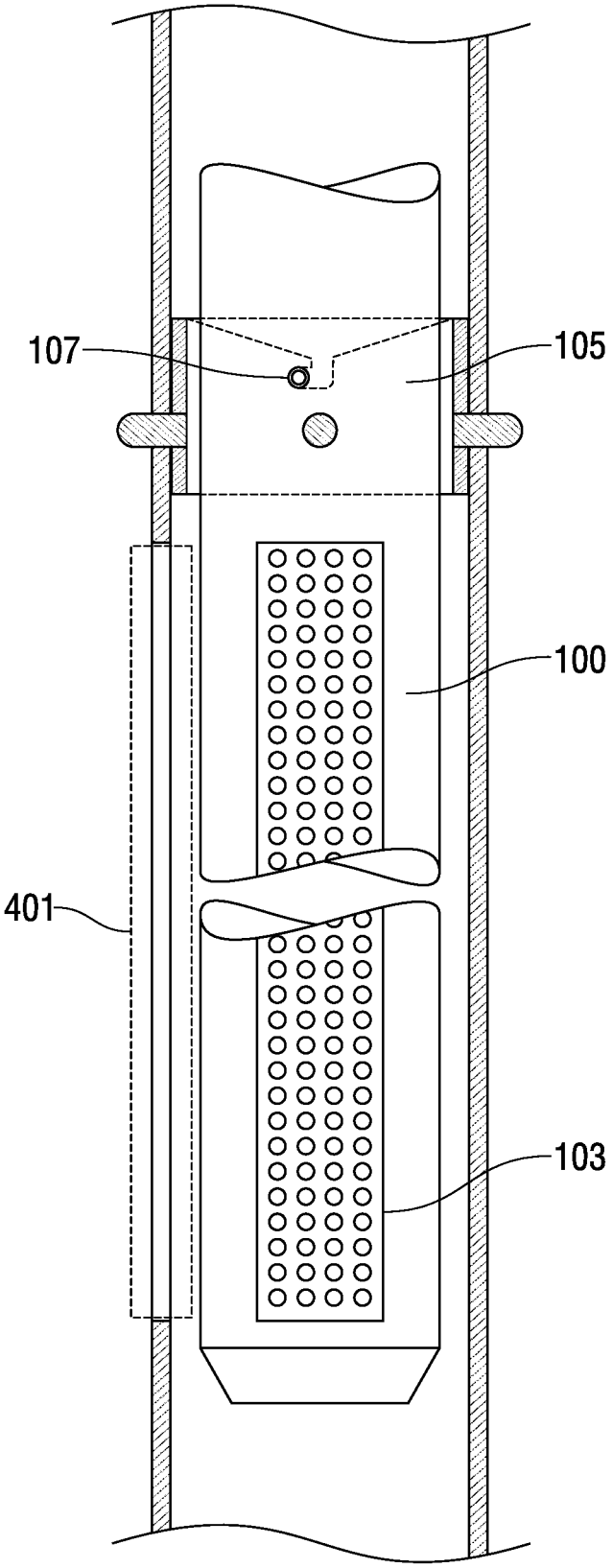
FIG. 4 illustrates radial indexing multiple deployments of a casing removal tool.

Each casing removal tool has a location/orientation lug 107 positioned to engage with the keyway 106 of the liner orientation tool 105. Since the keyway 106 of the liner orientation tool 105 remains in a constant radial/azimuthal orientation (i.e., it does not shift within the wellbore), the location/orientation lugs 107 of each of the four different casing removal tools 100 are indexed to a different position about the circumference of the casing removal tool, with respect to the nozzle array 103. Specifically, each of the location/orientation lugs 107 are positioned, such that the casing removal tool 100 orients to such that the nozzle array 103 covers a different 90° quadrant of the casing with each deployment. FIG. 4 illustrates a second deployment of the casing removal tool 100. The casing removal tool 100 has been indexed to a second position 90° rotated from the first position. A section of casing, represented by the dashed line 401, was removed during the first deployment of the casing removal tool 100.

Figure 5:
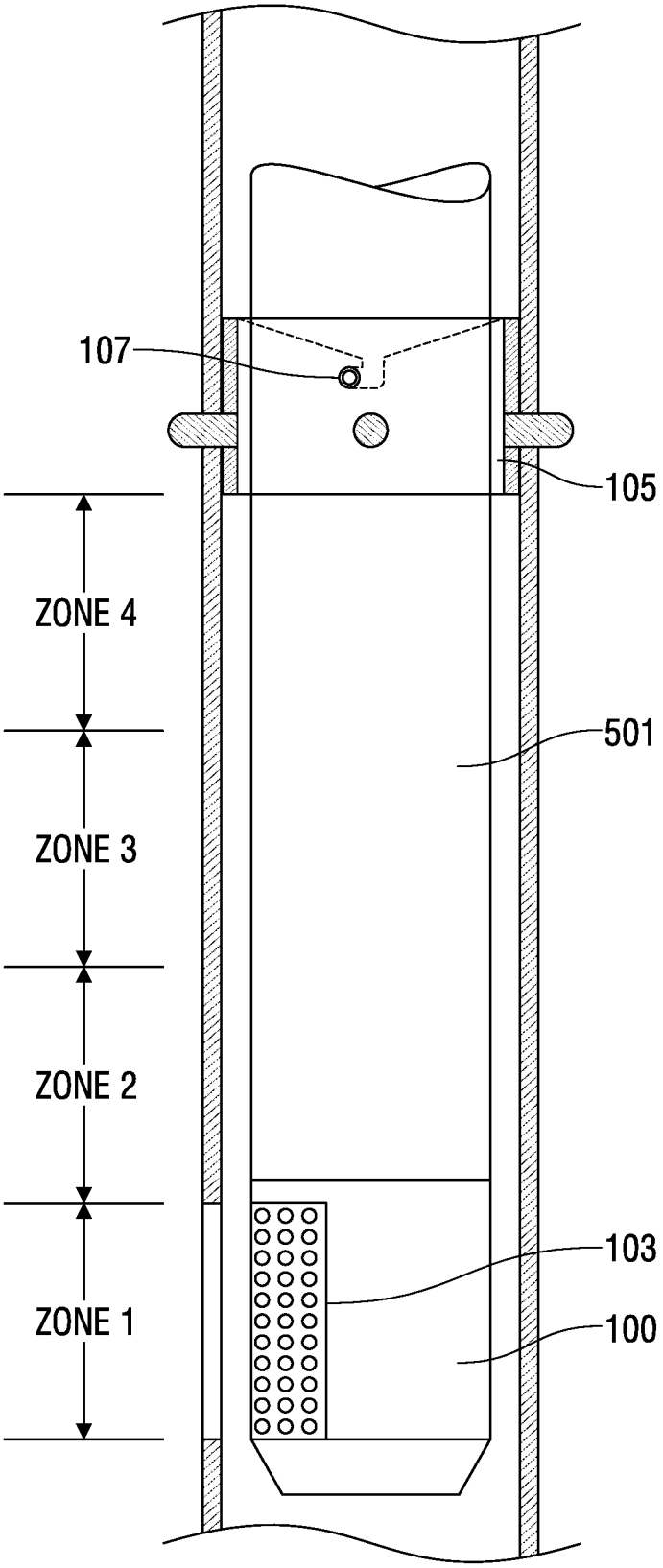
FIG. 5 illustrates a casing removal tool configured with a spacer for removing casing from multiple zones within a wellbore.

Depending on the particulars of a given casing removal operation, more or fewer deployments of a casing removal tool 100 may be required. This will be dependent on casing size, wall thickness and overall volume that can be reliably removed per thermite system deployed. For example, a larger or thicker casing might require more sustained contact with the molten thermite fuel. In such a case, a casing removal tool 100, having a nozzle array 103 covering an area of 60° instead of 90°, might be used, thus requiring six deployments. Alternatively, the casing removal tools 100 may be deployed in such a way that the radial areas, swept by the nozzle array 103 during each subsequent deployment, overlap somewhat. In each of those scenarios, the radial or azimuthal orientation of the casing removal tool within the wellbore is determined by indexing the position of the location/orientation lug 107 with respect to the nozzle array 103 on each of the casing removal tools 100. In addition to linear and azimuthal orientations, the casing removal tool 100 may be oriented away relative to a radial center of the wellbore through centralizers positioned along the casing removal tool 100. The centralizers may be located next to the orientation tool 105, or may be integrated such that the By deploying the system in a modular manner, sections of the casing can be removed over time. The overall length of casing removed can be accomplished by increasing the number of deployments. There is no practical limit to the overall length that can be achieved following this method. Casing lengths of 600 feet and greater can be removed using casing removal tools 100 that are 20 feet in length by simply repeating the process described above and stepping the casing removal tool 100 to a different vertical location within the wellbore as the previous vertical section is removed. For example, FIG. 5 illustrates a casing removal tool 100 offset from the liner orientation tool 105 by a spacer 501. The spacer 501 may be used for each casing removal tool 100 until all of the casing is removed from that "zone." A zone of casing means the entire circle of casing for a length of the wellbore equal to one length of the casing removal tool. As explained above, the zone may be 20 feet (about 3 meters) or more depending on the size of the nozzle array 103. The casing removal tool 100 is illustrated in the first indexed position in FIG. 5. Assuming that the nozzle array 103 covers a 90° radial area, as described above, four deployments of a casing removal tool 100 (each with a different 90° indexing) would be needed to remove all of the casing from Zone 1. Once the casing is entirely removed from Zone 1, the length of the spacer 501 can be decreased to allow removal from Zone 2. The process can then be repeated for Zones 3 and 4.

Depending on conditions, it may be necessary to remove shorter sections of casing sequentially. But, conveniently, the liner orientation tool 105 can be positioned at the most upper section of the wellbore where casing is to be removed. The first section of casing removed is typically lowermost portion of the overall interval so that falling slag and by-products from the removal process does not complicate removal of subsequent sections. Each zone may require a single deployment or multiple azimuthally indexed deployments to complete the removal process.

Figure 6:
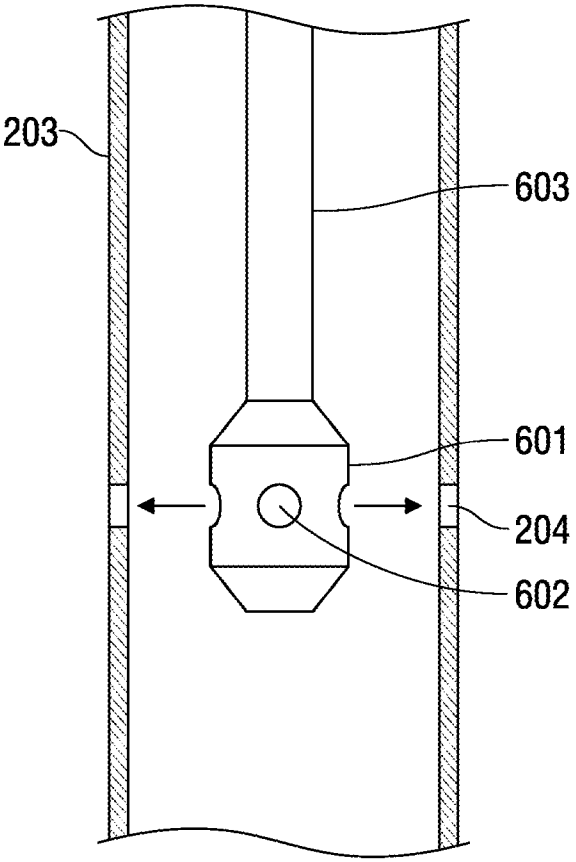
FIG. 6 illustrates a four-way perforating torch, usable for setting the orientation tool.

As shown in FIGS. 1-5, the liner orientation tool 105 allows for modular deployments of a casing removal tool 100 to remove sections of casing at multiple radial angles at a given depth within a wellbore and also at different depths within a wellbore. FIG. 6 illustrates a process for cutting anchor holes 204 in casing 203 using a four-way perforating torch 601. The four-way perforating torch uses molten thermite fuel ejected through nozzles 602 to cut holes 204 in the casing 203. The four-way perforating torch 601 can be deployed via a tool string 603, for example. Examples of four-way perforating torches 601, as well as other suitable torches are available from MCR Oil Tools (Arlington, Tex.). Once the anchoring holes 204 are cut, the liner orientation tool 105 can be deployed, as explained above.

Figure 7A:
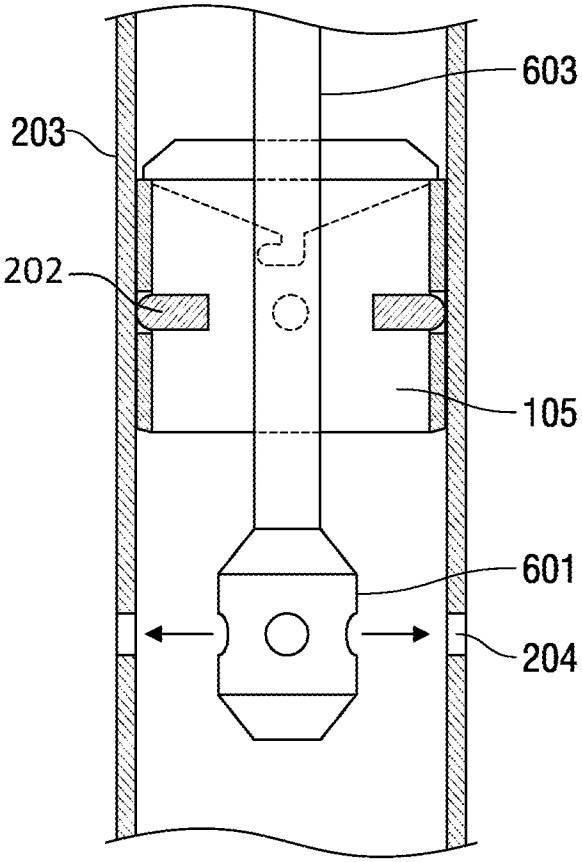
FIGS. 7A-7C illustrate deploying a four-way perforating torch and a liner orientation tool in a single trip.
Figure 7C:
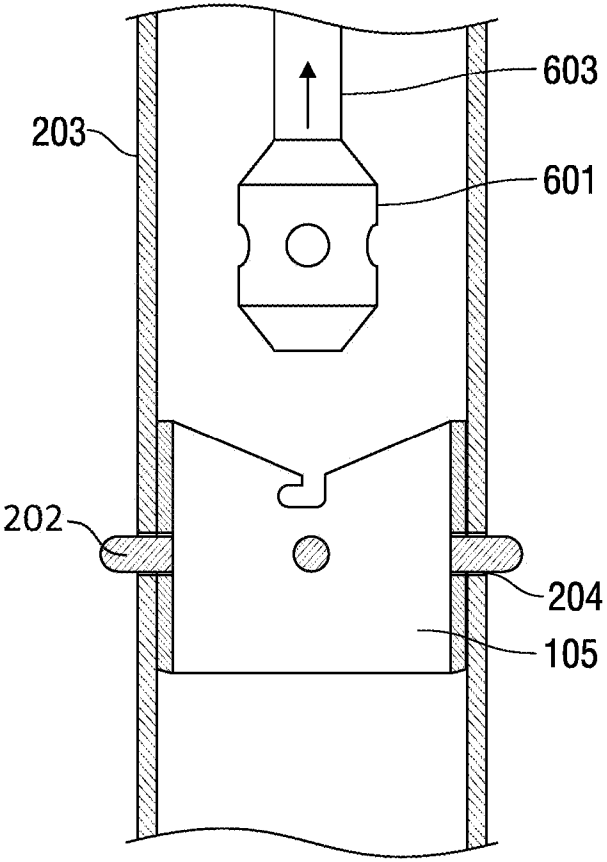
Figure 7B:
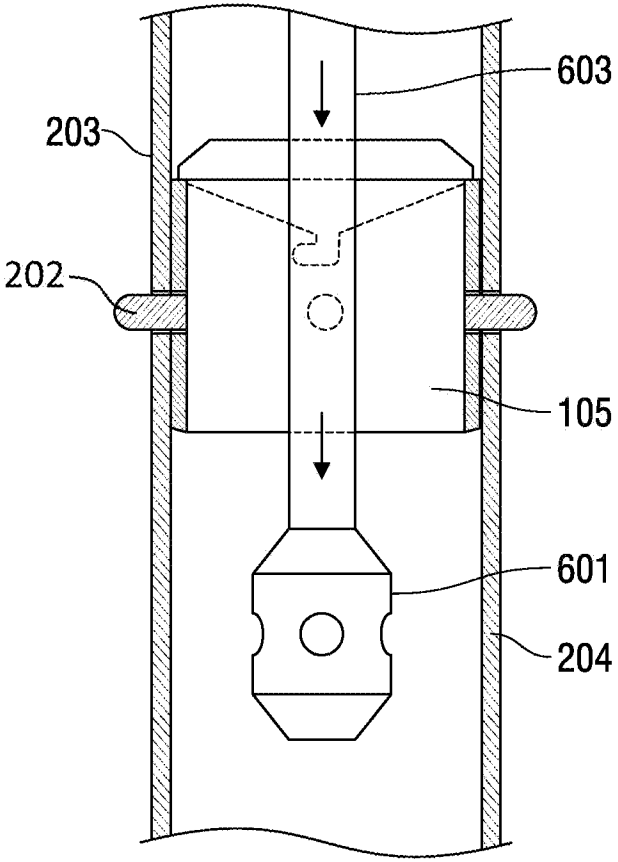

FIGS. 7A-7C illustrate an alternative method of deploying the liner orientation tool 105, wherein the four-way perforating torch 601 and the liner orientation tool 105 are both deployed on the same tool string 603 in a single trip. The liner orientation tool 105 is positioned above the four-way perforating torch 601 during the run in hole configuration with the four anchor dogs 202 in a retracted position but with their spring force acting on the ID of the casing. The four-way perforating torch 601 is initiated and creates the four anchor holes at 90° orientation. Once the anchor holes 204 are cut, the tool string 603 is lowered and the spring loaded anchor dogs 202 are allowed to seek and locate the anchor holes 204 (FIG. 7B). Over-pull is then applied to verify that the liner orientation tool 105 is anchored. Additional over-pull is applied to shear a predetermined weak point, freeing the four-way perforating torch 601 and tool string 603 from the liner orientation tool 105. FIG. 7C illustrates the process whereby the tool string 603 and four-way perforating torch 601 are retrieved from the wellbore leaving the liner orientation tool 105 in position. It should be noted that the liner orientation tool 105 could also be configured below the four-way perforating torch 601 on the tool string 603.

Figure 8:
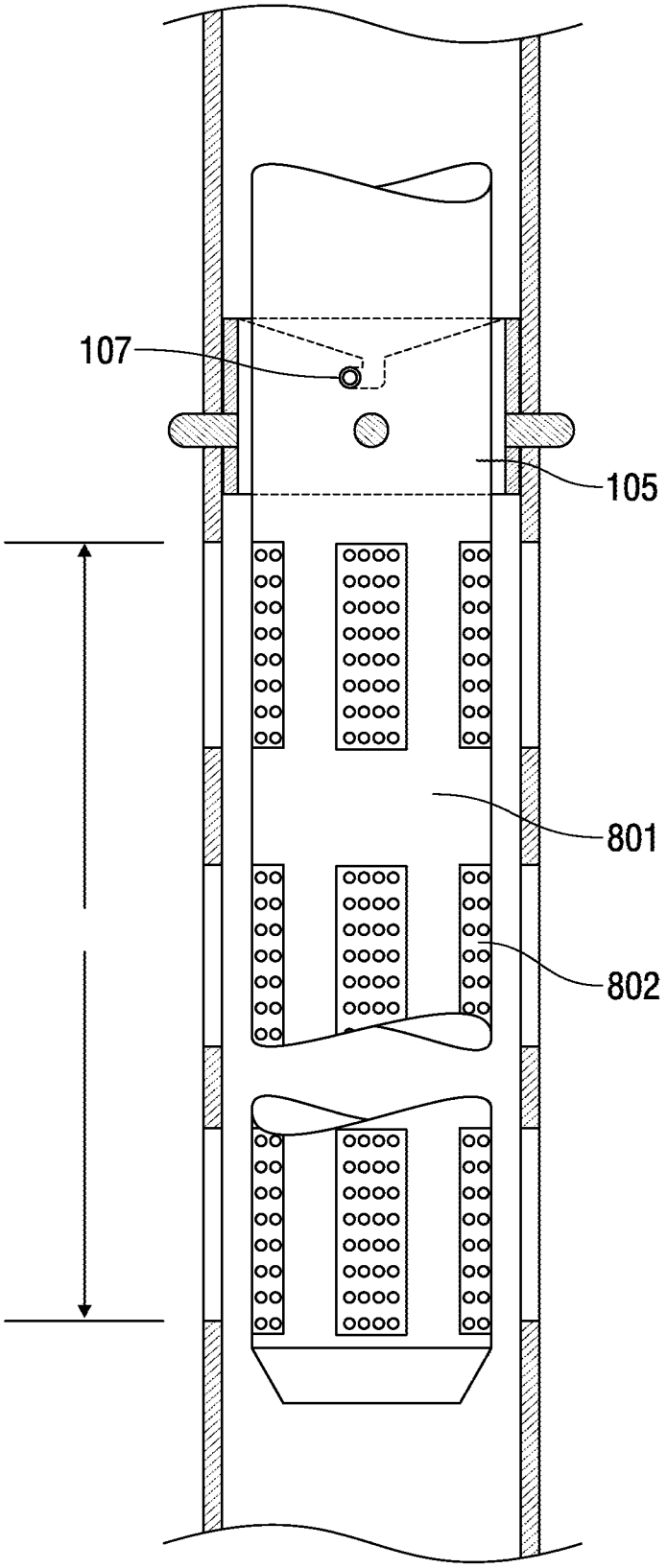
FIG. 8 illustrates a casing removal tool having multiple slotted nozzle arrays.

FIG. 8 illustrates another embodiment whereby the casing removal tool 801 is provided with a slot pattern of multiple nozzle arrays 802 within one tool configuration. Each nozzle array 802 contains a plurality of densely-packed nozzles that impinge on a continuous section of the wellbore casing, as described in detail above. The casing removal tool 801 provides a series of predetermined slots or holes in the well casing so that the cement barrier material can be easily and adequately displaced all around the casing without the need for high-pressure circulation. The same liner orientation tool 105 can be utilized for depth positioning within the wellbore and tool anchoring. Generally, the casing removal tool 801 does not need the indexing capability described above.

Figure 9:
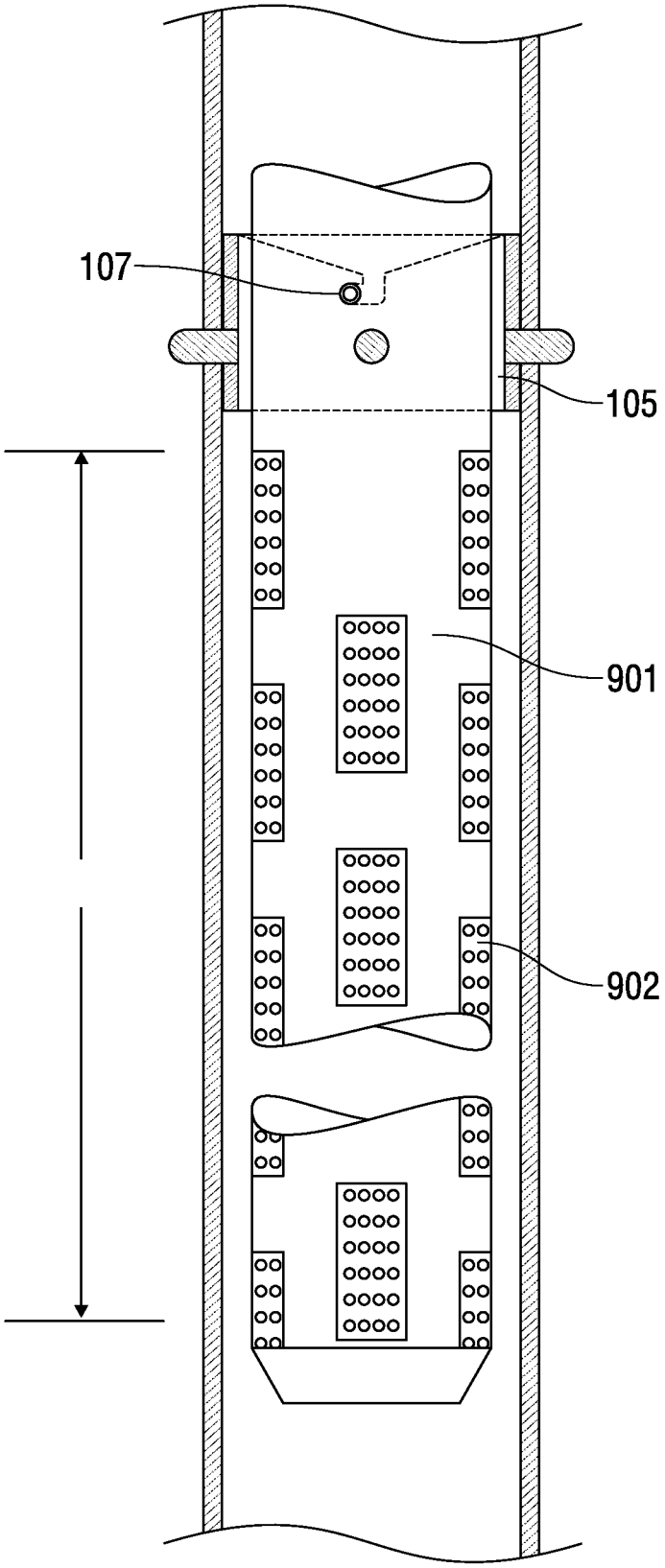
FIG. 9 illustrates a casing removal tool having a helical pattern of nozzle arrays.

FIG. 9 illustrates another embodiment of a casing removal tool 901 similar to 801, but wherein the slot pattern is a spiral or helical arrangement of nozzle arrays 902. The same liner orientation tool 105 can be used to achieve depth positioning within the wellbore and tool anchoring; although in this application, it is not necessary to utilize the indexing capability. Possible techniques for utilizing the casing removal tools 801, 901 that have multiple nozzle arrays include making several linear deployments without changing the azimuthal orientation. By changing only the linear orientation, an operator leaves strips of casing lengthwise along the wellbore. After the strips have been cut into the wellbore, additional 360° horizontal deployments may be used to cut the top and the bottom of the strips of remaining casing, creating splinters of free-floating casing. These splinters may fall down the wellbore without any further interaction. In certain cases, the splinters remain fixed to cement and/or geologic formation behind the casing. In these cases, a fluid wash may be used to agitate the splinters and any remaining cement from the wellbore. This creates a wellbore that is similar to a just-drilled wellbore, which may enable greater fixation of the cement plug for abandonment.

As described above, the casing removal tools disclosed herein use an exothermic reaction of thermite (or a modified thermite mixture) fuel to remove casing material. The thermite fuel may be in any form, but is typically loaded into the casing removal tool as solid pellets. The thermite can include pressed pellets of a powdered (or finely divided) metal and a powdered metal oxide. The powdered metal can be aluminum, magnesium, etc. The metal oxide can include cupric oxide, iron oxide, etc. A particular example of the thermite mixture is cupric oxide and aluminum. When initiated, the thermite material produces an exothermic reaction. The thermite material may also contain one or more gasifying compounds, such as one or more hydrocarbon or fluorocarbon compounds, particularly polymers.

The tubular body 102 of the casing removal tools described herein may be adapted to withstand the exothermic reaction of the thermite mixture. For example, it may be configured with a reaction-resistant coating, such as graphite or another material.

The thermite fuel load disposed within the tubular body 102 will generally be cylindrical in shape. According to certain embodiments, the thermite fuel load is initiated along the center of the longitudinal axis of the fuel load. Thus, the fuel load reacts from the inside out. An advantage of that reaction geometry is that the material closes to the inner diameter (ID) of the tubular body 102 is the last material to react; and therefore, this material provides some thermal insulation against the proceeding exothermic reaction. That thermal insulation, as set forth above, can help maintain structural integrity of the tool during the course of the reaction. However, it should be noted that other initiation/reaction geometries can be used. For example, according to certain embodiments, an off-center initiation provides increased expulsion velocity through the nozzle array.

Figure 10:
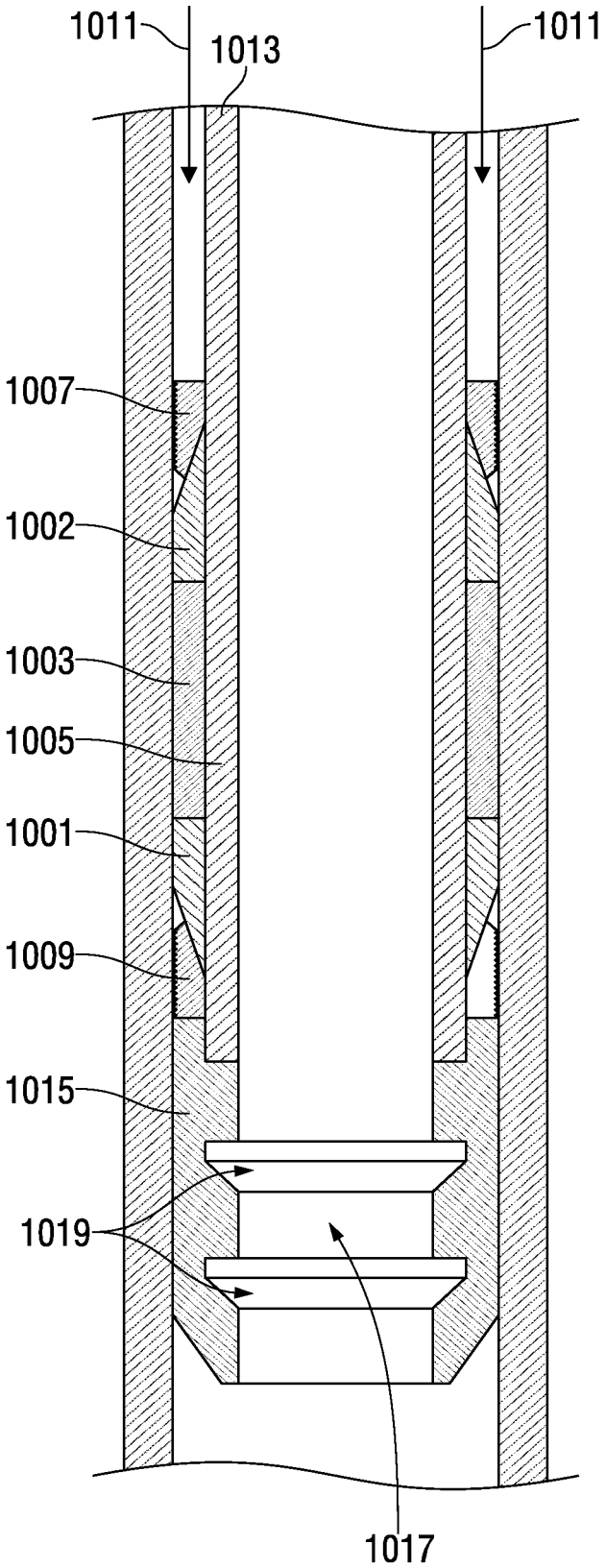
FIG. 10 illustrates an embodiment of an alternative orientation tool.

FIG. 10 illustrates an alternative embodiment of an orientation tool 1005 that is set within the wellbore. The orientation tool 1005 includes lower cones 1001 and upper cones 1002 that squeeze a sealing member 1003, maintaining a fluid-tight seal. Upper slips 1007 and lower slips 1009 are likewise forced into position and maintain the cones 1001, 1002 in position by biting into the wellbore with teeth.

Orientation tools, such as the orientation tool 1005 illustrated in FIG. 10, can be deployed within a wellbore using a setting tool. The setting tool can carry the orientation tool 1005 to the desired location within the wellbore. To deploy an orientation tool within a wellbore, a setting tool is typically connected to the orientation tool, and the setting tool and orientation tool are run down the wellbore using a slickline, wireline, coiled tubing, or other conveying method. The setting tool typically includes a sleeve that rides on the outside 1011 of a mandrel 1013 and applies push force to the slips 1007. The setting tool also typically engages a mandrel 1013 by a threaded connection or by a shear stud, for example, allowing the setting tool to apply pull force to the mandrel 1013. Once the setting tool reaches the desired depth within the wellbore, the setting tool deploys the orientation tool 1005 by actuating forces onto the upper slips 1007, which force is conveyed to the lower cones 1001, upper cones 1002, sealing member 1003, and lower slips 1009.

The embodiment of FIG. 10 illustrates that the orientation tool 1005 includes a cone 1015 that contains an inside diameter profile 1017, with a groove or a plurality of grooves 1019 into which a complementary projected profile of the casing removal tool 100 may engage. While FIG. 10 depicts grooves 1019 for mechanical engagement with complementary protrusions of an apparatus and/or string, it should be understood that in various embodiments, the grooves 1019, and/or the complementary protrusions for engagement therewith, can include one or more magnets for providing magnetic adhesion, and/or one or more chemicals (e.g., adhesives, epoxies, or similar substances) to provide a chemical adhesion.

Figure 11:
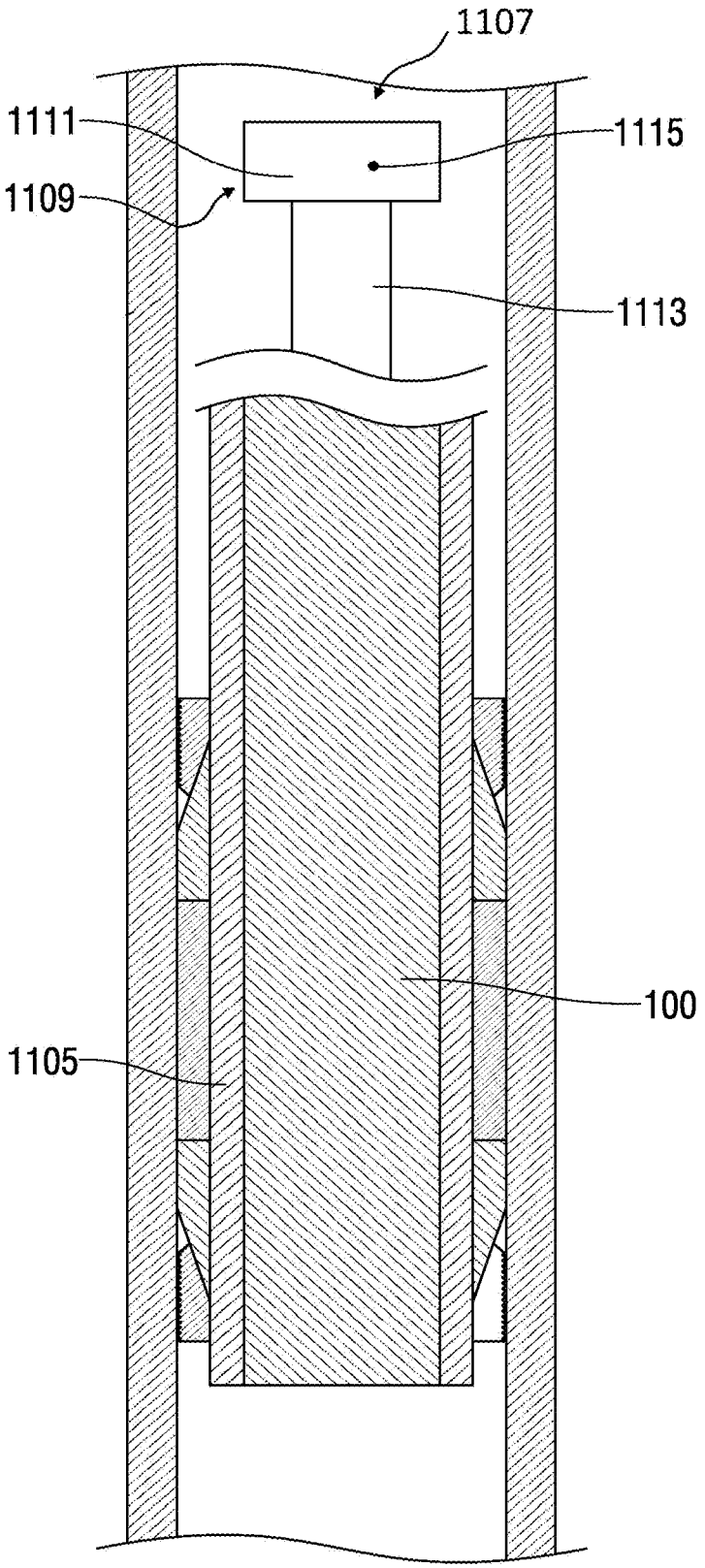
FIG. 11 illustrates an embodiment of an alternative orientation tool.

In further embodiments, other orienting techniques may be used to secure the casing removal tool 100. For example, FIG. 11 illustrates an embodiment of an orientation tool 1105 that utilizes a post-positioner 1107. The orientation tool 1105 can be set with a setting tool in a similar manner as described above with regard to FIG. 10. After the orientation tool 1105 is set, the casing removal tool 100 may be lowered onto a post area 1109 and secured to a post head 1111. The post head 1111 is located at the distal end of a post 1113 which may be a few centimeters to a meter or more in length. The post head 1111 includes an orientation nub 1115 which the casing removal tool 100 may orient by in a reversal of roles to the keyway 106 and orientation lug 107 described above. The post head 1111 may also include a complementary profile that fits into grooves (e.g., grooves 1019) as described above in regards to FIG. 10.

The foregoing disclosure and the showings made of the drawings are merely illustrative of the principles of this invention and are not to be interpreted in a limiting sense.

What is claimed is:

1. A casing removal tool for a rigless removal of a portion of a wellbore casing from a wellbore, comprising:

a tubular body configured to contain a thermite fuel mixture load comprising a gasifying compound and configured to initiate an exothermic reaction resulting in a molten thermite fuel;

a nozzle array comprising a plurality of densely packed nozzles positioned on an external surface of the tubular body, wherein the nozzle array is configured to project the molten thermite fuel onto a section of the wellbore casing so that the molten thermite fuel from each of the nozzles in the plurality of nozzles at least partially overlaps the molten thermite fuel from each adjacent nozzle in the plurality of nozzles; and an orientation lug configured to orient and anchor into a downhole orientation tool comprising a linear and azimuthal orientation keyway, wherein orientation of the orientation lug comprises a change in an azimuthal angle at which the orientation lug interacts with the linear and azimuthal orientation keyway to cause a change in a section of a casing at which said casing removal tool impinges molten thermite fuel onto the section of the casing.

2. The casing removal tool of claim 1, wherein the orientation lug is configured to be set by an operator at a specific orientation before entering the wellbore.

3. The casing removal tool of claim 1, comprising a second nozzle array configured to project the molten thermite fuel onto a second section of the wellbore casing.

4. The casing removal tool of claim 1, wherein an area of the nozzle array comprises one quarter of a total area of the external surface.

5. The casing removal tool of claim 4, wherein the area of the nozzle array comprises up to a 90° or more rectangular area with the plurality of nozzles uniformly spaced within the rectangular area.

6. The casing removal tool of claim 1, comprising a spacer configured to offset the nozzle array a linear offset distance from the downhole orientation tool.

7. The casing removal tool of claim 1, comprising a centralizer configured to orient the casing removal tool relative to a radial center of the wellbore.

8. The casing removal tool of claim 1, wherein the plurality of densely packed nozzles are in an area on the external surface of the tubular body, and the nozzles occupy more than 50 percent of the area.

9. A method of removing casing from a wellbore with a casing removal tool, comprising:

lowering and setting a downhole orientation tool in the wellbore, the downhole orientation tool comprising a linear and azimuthal orientation keyway;

lowering the casing removal tool into the wellbore, the casing removal tool comprising an orientation lug configured to orient and anchor into the downhole orientation tool;

orienting the casing removal tool within the wellbore at a first linear orientation and a first azimuthal orientation by adjusting an azimuthal angle at which the orientation lug interacts with the linear and azimuthal orientation keyway, wherein the casing removal tool comprises a tubular body configured to contain a thermite fuel mixture load comprising a gasifying compound;

initiating a burn of the thermite fuel mixture to produce an exothermic reaction resulting in a molten thermite fuel;

projecting the molten thermite fuel through a nozzle array comprising a plurality of nozzles positioned adjacent to one another;

impinging the molten thermite fuel onto a section of the casing to melt, vaporize, and/or disintegrate the casing, wherein the molten thermite fuel from each of the nozzles in the plurality of nozzles at least partially overlaps the molten thermite fuel from each adjacent nozzle in the plurality of nozzles; and retrieving the casing removal tool from the wellbore.

10. The method of claim 9, further comprising:

lowering an additional casing removal tool into the wellbore;

orienting, while lowered into the wellbore, the additional casing removal tool within the wellbore, wherein the additional casing removal tool is oriented at a combination of linear orientation and azimuthal orientation that is different from the linear orientation and azimuthal orientation of any previously lowered casing removal tool;

initiating a burn of the thermite fuel mixture load within the additional casing removal tool to produce a molten thermite fuel;

impinging the molten thermite fuel onto an additional section of the casing, wherein each additional section of the casing is at least partially different from each previous section of the casing; and retrieving the additional casing removal tool from the wellbore before lowering a next additional casing removal tool.

11. The method of claim 10, wherein each of the casing removal tools is configured to linearly and azimuthally orient based on the downhole orientation tool.

12. The method of claim 11, comprising lowering a spacer with each of the casing removal tools to linearly offset each of the casing removal tools from the downhole orientation tool.

13. The method of claim 12, wherein the spacer comprises a length to linearly position the casing removal tool relative to a zone of the casing, and wherein the casing removal tool removes at least a portion of the casing in the zone prior to an adjusting of the length of the spacer for the additional casing removal tool or the next additional casing removal tool.

14. The method of claim 11, wherein setting the downhole orientation tool comprises perforating holes into the casing with a perforating torch and securing anchor dogs of the downhole orientation tool into the perforated holes, setting a sleeve hanger or a post-positioner with a setting tool, or combinations thereof.

15. The method of claim 9, wherein orienting the casing removal tool further comprises offsetting the casing removal tool from a radial center of the wellbore towards the casing.

16. The method of claim 15, wherein the casing removal tool is offset toward the section of the casing impinged by the molten thermite fuel.

17. The method of claim 9, wherein lowering the casing removal tool into the wellbore comprises using a wireline, a slickline, other rigless tool lowering strings, or combinations thereof.

18. The method of claim 9, wherein lowering and orienting the casing removal tool comprises lowering and orienting the casing removal tool by attaching the casing removal tool to an end of a production tubing drill string.

19. The method of claim 9, further comprising changing the section of the casing at which said casing removal tool impinges the molten thermite fuel onto the section of the casing by interacting the orientation lug with the linear and azimuthal orientation keyway.

20. A system for removing wellbore casing from a wellbore, comprising:

a downhole orientation tool configured to be secured within the wellbore, wherein the downhole orientation tool comprises a linear and azimuthal orientation keyway; and a plurality of casing removal tools, wherein each casing removal tool comprises:

an orientation lug configured to orient within the keyway of the downhole orientation tool, wherein an operator can change a position of the orientation lugs before lowering the casing removal tools into the wellbore, and wherein the change in the position comprises a change in an azimuthal angle at which the orientation lug interacts with the linear and azimuthal orientation keyway to cause a change in a section of a casing at which said each casing removal tool impinges molten thermite fuel onto the section of the casing;

a nozzle array comprising a plurality of densely packed nozzles configured to project the molten thermite fuel comprising a gasifying compound onto a continuous section of the wellbore casing after the casing removal tool is lowered into the wellbore; and a spacer configured to offset the nozzle array a linear distance from the downhole orientation tool.

21. The system of claim 20, comprising a second spacer configured to offset the nozzle array a second linear distance from the downhole orientation tool.

22. The system of claim 20, wherein the downhole orientation tool comprises a sleeve hanger, a post-positioner, or combinations thereof.

23. The system of claim 20, wherein each casing removal tool in the plurality of casing removal tools comprises a nozzle array approximately 6 to 7 meters or more in length and about 90 degrees around an external surface of the casing removal tool.

24. The system of claim 20, comprising a centralizer configured to orient the casing removal tool relative to a radial center of the wellbore.

25. The system of claim 20, further comprising small splinters of the wellbore casing that are retrieved from the wellbore, removed from the wellbore, or allowed to fall down the wellbore, wherein the small splinters of the wellbore casing are located between the continuous sections of the wellbore casing.

26. A method of removing casing from a wellbore, comprising:

lowering a casing removal tool into the wellbore through a first wellbore tubing comprising a first diameter, wherein the wellbore comprises the first wellbore tubing and a second wellbore casing, and the casing removal tool comprises a nozzle section;

lowering the casing removal tool through the second wellbore casing comprising a second diameter, wherein the second diameter is larger than the first diameter and the second wellbore tubing is downhole from the first wellbore tubing;

orienting the casing removal tool within the second wellbore casing;

initiating the casing removal tool to remove casing from the second wellbore casing; and retrieving the casing removal tool including the nozzle section from the wellbore, wherein orienting the casing removal tool comprises anchoring the casing removal tool to an orientation tool that remains secured within the wellbore after the casing removal tool including the nozzle section has been retrieved from the wellbore.

27. The method of claim 26, wherein orienting the casing removal tool further comprises offsetting the casing removal tool from a radial center of the wellbore towards the casing.

28. A casing removal tool for a rigless removal of a portion of a wellbore casing from a wellbore, comprising:

a tubular body configured to contain a thermite fuel mixture load comprising a gasifying compound and configured to initiate an exothermic reaction resulting in a molten thermite fuel, wherein the thermite fuel mixture load comprises an outer part adjacent to an inner diameter of the tubular body and a longitudinal axis at a central part of the thermite fuel mixture load, wherein the thermite fuel mixture load is configured to initiate along the longitudinal axis so that the thermite fuel mixture load reacts from the central part towards the outer part, whereby the outer part provides a thermal insulation against the exothermic reaction;

a nozzle array comprising a plurality of densely packed nozzles positioned on an external surface of the tubular body, wherein the nozzle array is configured to project the molten thermite fuel onto a section of the wellbore casing so that the molten thermite fuel from each of the nozzles in the plurality of nozzles at least partially overlaps the molten thermite fuel from each adjacent nozzle in the plurality of nozzles; and an orientation lug configured to anchor into a downhole orientation tool.

* * * * *